US006147652A

United States Patent [19]

Sekine

[11] Patent Number: 6,147,652

[45] Date of Patent: Nov. 14, 2000

[54] ANTENNA APPARATUS

[75] Inventor: Syuichi Sekine, Kanagawa-Ken, Japan

[73] Assignee: Kabushiki Kaisha Toshiba, Kawasaki, Japan

[21] Appl. No.: 09/156,868

[22] Filed: Sep. 18, 1998

[30] Foreign Application Priority Data

Sep. 19, 1997 [JP] Japan ..... 9-254432
Jul. 17, 1998 [JP] Japan ..... 10-203024

[51] Int. Cl.[7] ..... H01Q 1/24; H01Q 1/38

[52] U.S. Cl. ..... 343/702; 343/700 MS

[58] Field of Search ..... 343/702, 700 MS; 455/90; H01Q 1/24, 1/38

[56] References Cited

U.S. PATENT DOCUMENTS

| | | | |
|---|---|---|---|
| 5,517,676 | 5/1996 | Sekine et al. | 455/89 |
| 5,550,554 | 8/1996 | Erkocevic | 343/702 |
| 5,668,560 | 9/1997 | Evans et al. | 343/702 |
| 5,966,097 | 10/1999 | Fukasawa et al. | 343/702 |

*Primary Examiner*—Hoanganh Le
*Attorney, Agent, or Firm*—Oblon, Spivak, McClelland, Maier & Neustadt, P.C.

[57] ABSTRACT

An antenna apparatus includes a rectangular conductor plate having a longitudinal length of one fourth the wavelength of a signal having an operating frequency and a line-shaped inverted F antenna mounted thereon. The line-shaped inverted F antenna is disposed at one end in the longitudinal direction of the conductor plate so as to be perpendicular to the longitudinal sides of the conductor plate.

10 Claims, 12 Drawing Sheets

ANTENNA APPARATUS

BACKGROUND OF THE INVENTION

1. Field of the Invention

The present invention relates to compact antenna apparatuses such as those used for portable radio terminals.

2. Discussion of the Background

In recent years, it has been important for portable radio terminals to be compact and thin for improved portability. As portable radio terminals have been made compact, however, the effectiveness of the antenna used therein may deteriorate. This tendency becomes especially prominent with a built-in antenna such as an inverted F antenna.

FIG. 11 shows a conventional compact antenna apparatus in which a line-shaped inverted F antenna is disposed on a conductor plate. A line-shaped inverted F antenna 1101 is connected to a conductor plate 1102 by a short-circuited line 1103 and a power-feed line 1104. A portable radio terminals having an operational frequency of 800 MHz is used as an example. The radio terminals, is shown simply by a conductor plate. The longitudinal length L of the conductor plate 1102 is set to one fourth the wavelength of a signal having the specified operational frequency, in the example, one fourth of the wavelength of an 800 MHz signal.

FIG. 12 is a graph showing the radiation efficiency of the line-shaped inverted F antenna 1101 shown in FIG. 11. The horizontal axis indicates the longitudinal length L of the conductor plate 1102 shown in FIG. 11. It is understood from this graph that the efficiency becomes −3 dB or less when the longitudinal length of the conductor plate becomes one fourth the wavelength or less. This indicates that about half the power supplied to the antenna 1101 is lost in the antenna 1101. This deterioration may occur in a compact antenna such as a line-shaped inverted F antenna as a result of the compact conductor plate.

As described above, as a portable radio terminals have been made compact, antenna performance may deteriorate. Especially with a compact antenna apparatus such as an inverted F antenna mounted on a conductor plate having a length of about one fourth the wavelength, the degree of deterioration is high and stable communication may be impeded.

SUMMARY OF THE INVENTION

Accordingly, it is an object of the present invention to provide a compact antenna apparatus having reduced deterioration and improved radiation efficiency.

The foregoing object is achieved in one aspect of the present invention through the provision of an antenna apparatus comprising: a conductor plate formed of electrically conductive material and having at least of one side in the longitudinal direction with a length of one fourth the wavelength corresponding to a certain operating frequency, and having a short-circuited point disposed in the vicinity at least of one end to said side in the longitudinal direction with a length of one fourth the wavelength, and a power-feed point disposed in the vicinity at least of one end to said side in the longitudinal direction with a length of one fourth the wavelength; a first element connected at one end to said conductor plate at said short-circuited point; a second element connected at one end to said conductor plate at said power-feed point; and a third element connected at one end to said first element, connected to said second element such that the length from said power-feed point to another end of the third element is equal to one fourth the wavelength, and disposed substantially perpendicularly to said side in the longitudinal direction with a length of one fourth the wavelength of said conductor plate.

In the antenna apparatus, a rectangular-shaped conductor plate formed of electrically conductive material and having two sides in a longitudinal direction with a length of one fourth the wavelength corresponding to a certain operating frequency; a short-circuited point disposed in the vicinity of at least one side of two sides substantially perpendicular to the two sides in the longitudinal direction of said rectangular-shaped conductor plate; a first line-shaped element connected at one end to said rectangular-shaped conductor plate at said short-circuited point; a power-feed point disposed in the vicinity of at least one side of the two sides substantially perpendicular to the two sides in the longitudinal direction of said rectangular-shaped conductor plate; a second line-shaped element connected at one end to said rectangular-shaped conductor plate at said power-feed point; and a third line-shaped element connected at one end to said first line-shaped element, connected to said second line-shaped element such that the length from said power-feed point to another end of the third line-shaped element is equal to one fourth the wavelength, and disposed substantially perpendicularly to the two sides in the longitudinal direction of said rectangular-shaped conductor plate.

In the antenna apparatus, the power-feed point and said short-circuited point are disposed in the vicinity of a corner of said rectangular-shaped conductor plate.

In the antenna apparatus, the third line-shaped element is disposed substantially at a right angle at a first disposed section near the other end and disposed substantially at a right angle at a second disposed section closer to the other end than the first disposed section.

In the antenna apparatus, the other-end portion of said third line-shaped element disposed at the second disposed section is substantially perpendicular to the two sides in the longitudinal direction of said rectangular-shaped conductor plate.

In the antenna apparatus, the portion from the first disposed section to the second disposed section of said third line-shaped element is substantially parallel to the two sides in the longitudinal direction of said rectangular-shaped conductor plate.

In the antenna apparatus, the portion from the first disposed section to the second disposed section of said third line-shaped element is disposed toward said rectangular-shaped conductor plate.

In the antenna apparatus, a rectangular-shaped conductor plate formed of electrically conductive material and having two sides in a longitudinal direction have a length of one fourth the wavelength corresponding to a certain operating frequency; a power-feed point disposed in the vicinity of at least one side of two sides of the rectangular-shaped conductor plate substantially perpendicular to the two sides in the longitudinal direction of said rectangular-shaped conductor plate; a first line-shaped element connected at one end to said rectangular-shaped conductor plate at said power-feed point; and a second line-shaped element connected at one end to said first line-shaped element, having the length from said power-feed point to the other end equal to one fourth the wavelength, and disposed substantially perpendicularly to the two sides in the longitudinal direction of said rectangular-shaped conductor plate.

In the antenna apparatus, the power-feed point is disposed in the vicinity of a corner of said rectangular-shaped conductor plate.

In the antenna apparatus, the second line-shaped element is disposed substantially at a right angle at a first disposed section near the other end and disposed substantially at a right angle at a second disposed section closer to the other end than the first disposed section.

In the antenna apparatus, the other-end portion of said second line-shaped element disposed at the second disposed section is substantially perpendicular to the two sides in the longitudinal direction of said rectangular-shaped conductor plate.

In the antenna apparatus, the portion from the first disposed section to the second disposed section of said second line-shaped element is substantially parallel to the two sides in the longitudinal direction of said rectangular-shaped conductor plate.

In the antenna apparatus, the portion from the first disposed section to the second disposed section of said second line-shaped element is disposed toward said rectangular-shaped conductor plate.

In the antenna apparatus, the third line-shaped element is disposed substantially at a right angle at a first disposed section near the other end, disposed substantially at a right angle at a second disposed section closer to the other end than the first disposed section, and disposed substantially at a right angle at a third disposed section closer to the other end than the second disposed section.

In the antenna apparatus, the second line-shaped element is disposed substantially at a right angle at a first disposed section near the other end, disposed substantially at a right angle at a second disposed section closer to the other end than the first disposed section, and disposed substantially at a right angle at a third disposed section closer to the other end than the second disposed section.

In the antenna apparatus, the third line-shaped element has a U shape or a J shape.

In the antenna apparatus, the second line-shaped element has a U shape or a J shape.

DESCRIPTION OF THE PREFERRED EMBODIMENTS

Figure 1:
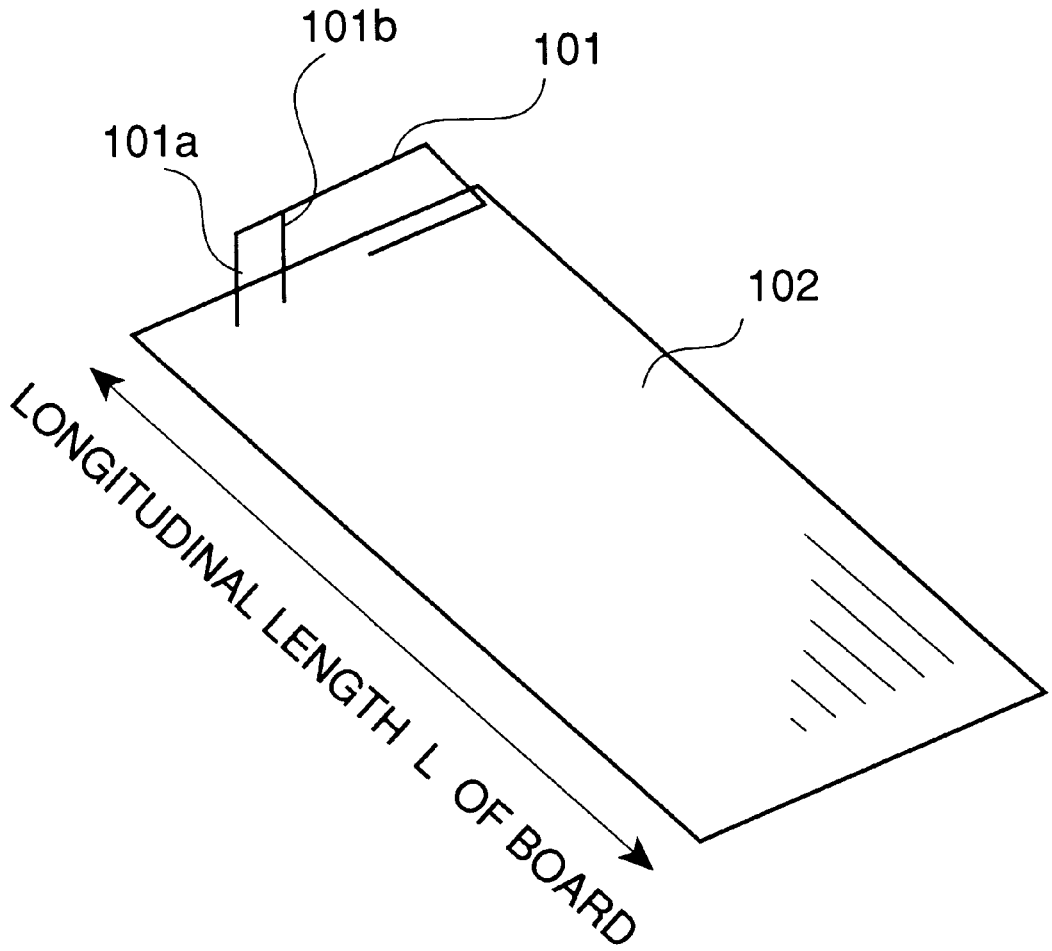
FIG. 1 is a perspective view of an antenna apparatus according to an embodiment of the present invention.

Embodiments of the present invention are described below by referring to the drawings.

FIG. 1 is a perspective view of an antenna apparatus according to an embodiment of the present invention. In FIG. 1, an antenna 101 and a conductor plate 102 are shown. The antenna 101 is mounted at an end of the conductor plate 102 through a short-circuited line 101*a* and a power-feed line 101*b* so as to be perpendicular to the two sides of the conductor plate 102 in the longitudinal direction. The antenna 101 is disposed so that it fits over the conductor plate 102.

Figure 2:
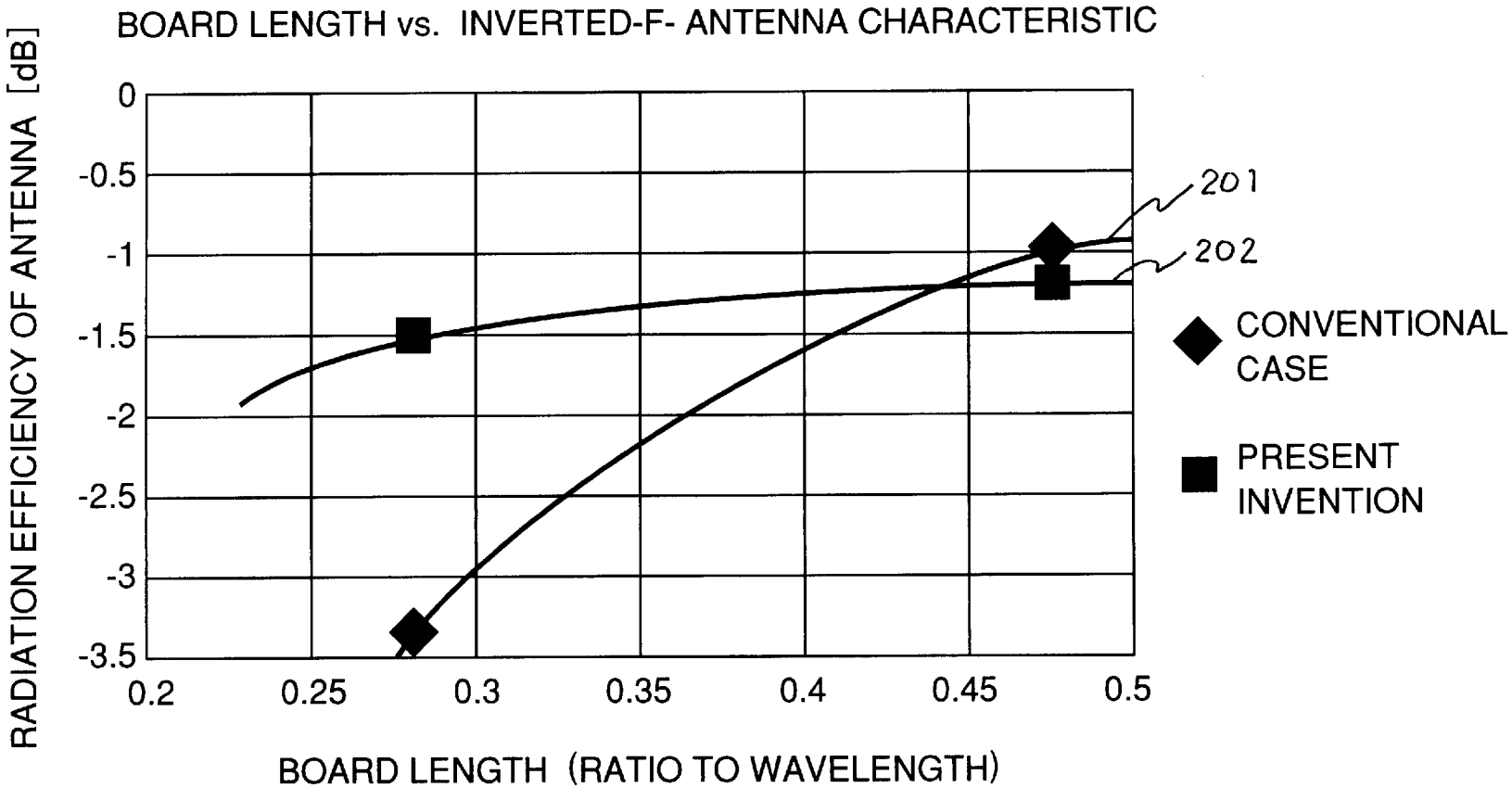
FIG. 2 is a graph showing a characteristic of the antenna apparatus of FIG. 1 according to the embodiment of the present invention.

FIG. 2 is a graph showing results of measurement performed by the use of a radio antenna model formed based on the antenna apparatus shown in FIG. 1. A line 202 shows the radiation efficiency of the antenna 101. In the graph, the vertical axis indicates the radiation efficiency of the antenna 101 and the horizontal axis indicates the length of the conductor plate 102.

For comparison, the radiation efficiency of a conventional antenna is also shown in the graph as a line 201. It is understood from the graph that a constant antenna gain is obtained irrespective of the length of the conductor plate in an antenna arrangement according to the present invention. Especially at a plate length of one fourth the wavelength, the efficiency is improved by about 2 dB as compared with the conventional method.

The reason why efficiency is improved by changing the antenna arrangement is described below. When a line-shaped inverted F antenna is disposed on a board, since the antenna has a low profile, the amount of electromagnetic-wave radiation from the board becomes larger than that from the antenna itself.

Figure 3:
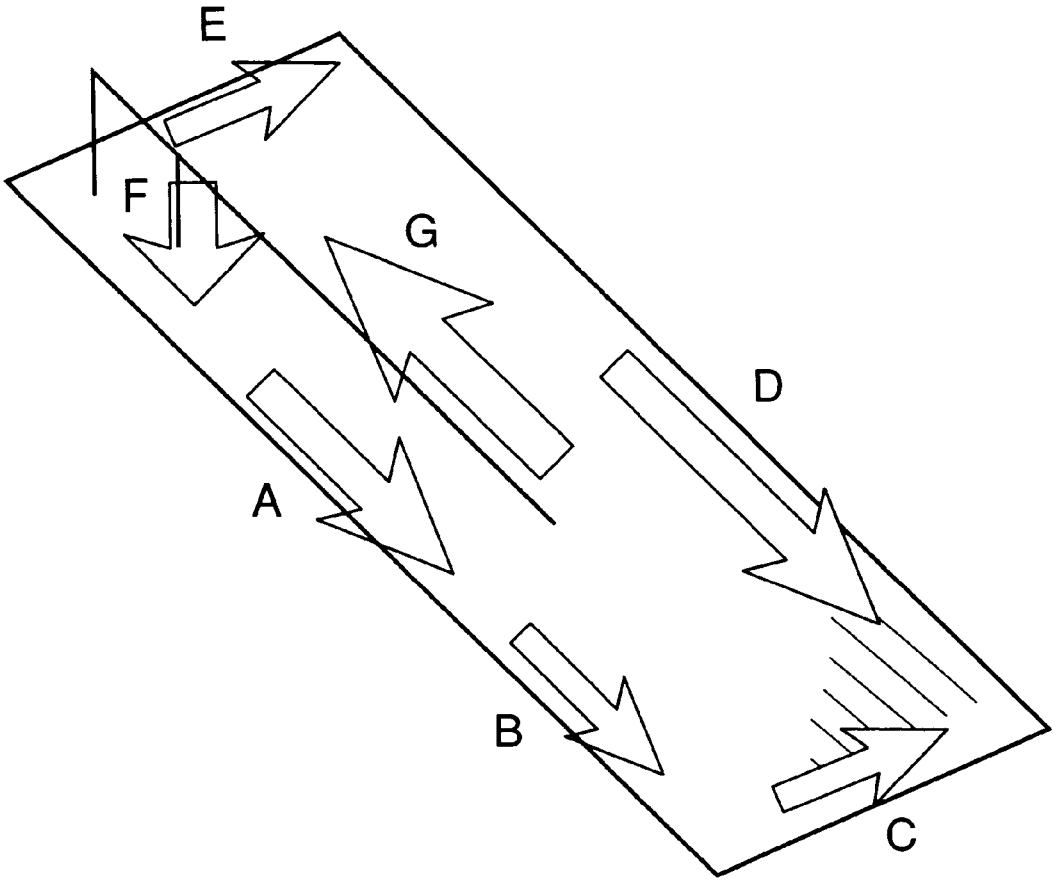
FIG.3 PRIOR ART
FIG. 3 is a view of current distribution in a conventional antenna apparatus.

FIG. 3 roughly shows current flows on a board and an antenna in a conventional antenna apparatus to explain the foregoing event. Radiation from the line-shaped inverted F antenna itself is generated only from a current F, which flows perpendicularly to the board. Although a current G also flows in parallel to the board on the line-shaped inverted F antenna, since radiation from the current G is canceled by a current A, which leaks from the antenna to the board, it does not contribute to radiation. Since the current G flows in the opposite direction to that of the current A, the radiation field caused by the current G and that caused by the current A cancel each other.

An electromagnetic wave radiated from the board is caused by a high-frequency current flowing from the antenna to the board. From the board, most radiation is produced at a current B, a current C, a current D, and a current E, which flows at the ends (surroundings) of the board. A high-frequency current is generally distributed more at an end of a board. The currents B and D contribute much to radiation and the currents C and E contribute, because the lengths of the portions where the currents C and E flow are short.

As described above, radiation from the antenna itself is generated by the current F. The radiation resistance of the portion where the current F flows is about 600 milliohms with an assumption that the height of the antenna is one fiftieth the wavelength (the wavelength corresponds to the frequency of the signal used in the antenna). On the other hand, radiation is produced from the currents B, C, D, and F on the board. The corresponding radiation resistance is about 3000 milliohms when the board length is half the wavelength. Therefore, in such a case, it is obvious that the amount of radiation is larger from the board than from the antenna.

Assume here that the board becomes short. For example, assume that the board length is one fourth the wavelength in the above model. The radiation resistance of the antenna is about 600 milliohms, which is the same as in the above case. On the other hand, the radiation resistance of the board is 1000 milliohms, which is one third that obtained when the board length is one half the wavelength.

Figure 4:
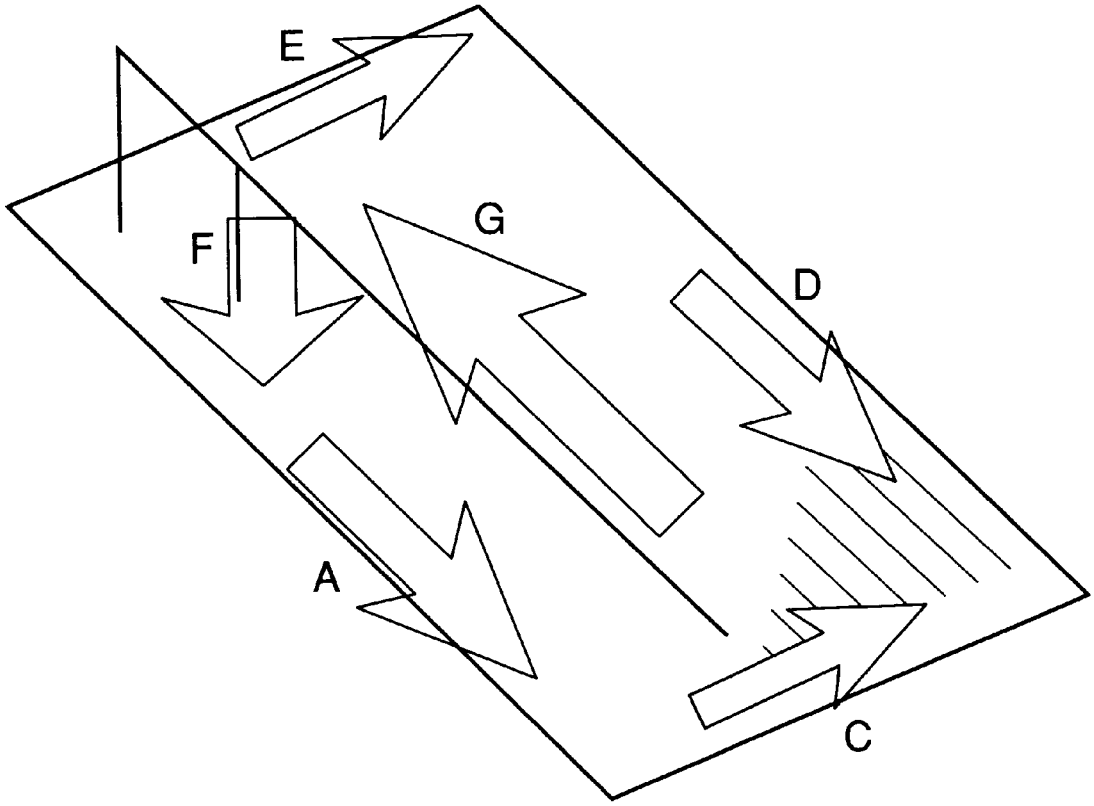
FIG.4 PRIOR ART
FIG. 4 is a view of current distribution in another conventional antenna apparatus.

FIG. 4 roughly shows current distribution in a case when the board length is one fourth the wavelength. Compared to the cases in which the board length is long, it is understood that the current B and half the current D disappear when the board length is short, which means that a little current distribution contributes to radiation. As described above, when the board becomes short, the amount of electromagnetic radiation is reduced and the antenna performance deteriorates.

Figure 5:
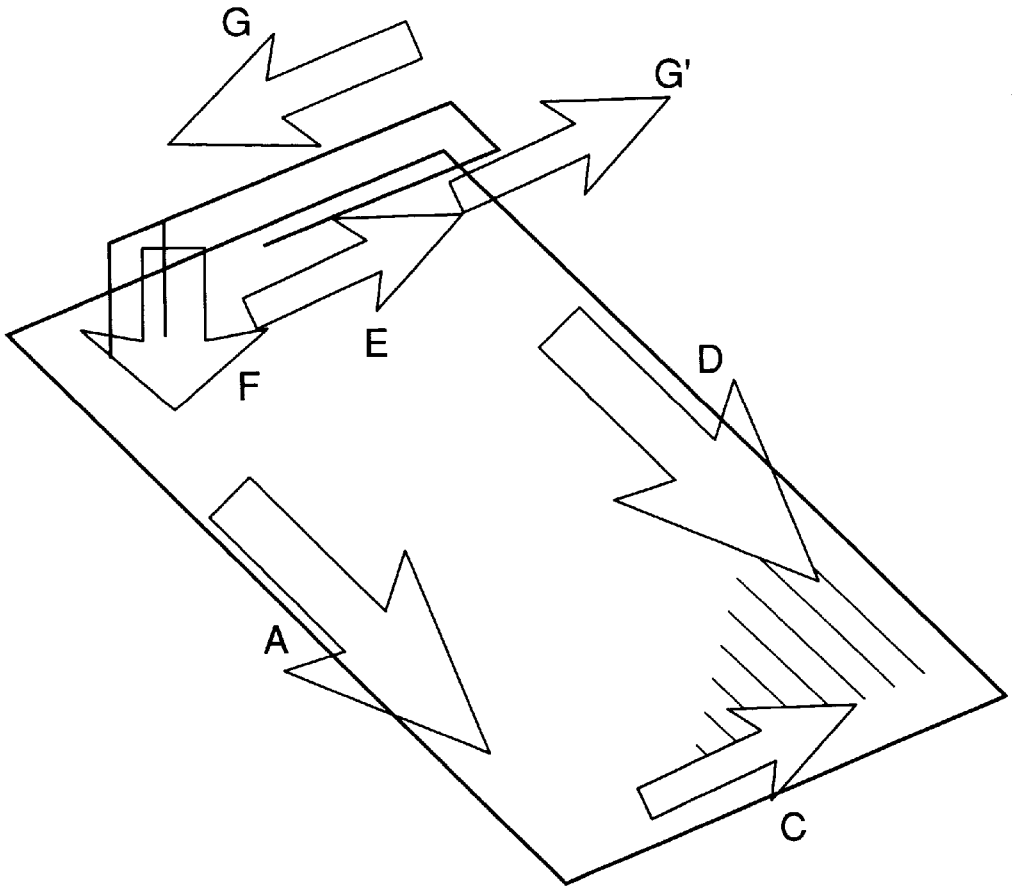
FIG. 5 is a view of current distribution in the antenna apparatus of FIG. 1 according to the embodiment of the present invention.

An antenna arrangement according to the present invention is described below. FIG. 5 roughly shows the current distribution of an antenna according to the present invention. In this case, relatively high current distributions A and D remain, and greatly contribute to radiation. Therefore, as compared with the conventional antenna arrangement shown in FIG. 4, the amount of radiation from the board increases and as a result, the antenna radiation efficiency is improved. The radiation resistance of the board in this embodiment is 3000 milliohms when the board length is one fourth the wavelength, which is three times larger than that in a case in which the elements are arranged in the longitudinal direction of the board.

In the inverted F antenna apparatus shown in FIG. 1, a line-shaped element of the antenna 101 is disposed perpendicularly at disposed sections near an end. The way the element is disposed is not limited to that in this case. The element is disposed toward the other end of the conductor plate. The direction in which the element is disposed is not limited to that direction. The element may be disposed over the conductor plate.

FIGS. 6 to 10 illustrate modifications of the antenna apparatus shown in FIG. 1. These modifications achieve the same advantages as those of the antenna apparatus shown in FIG. 1.

Figure 6:
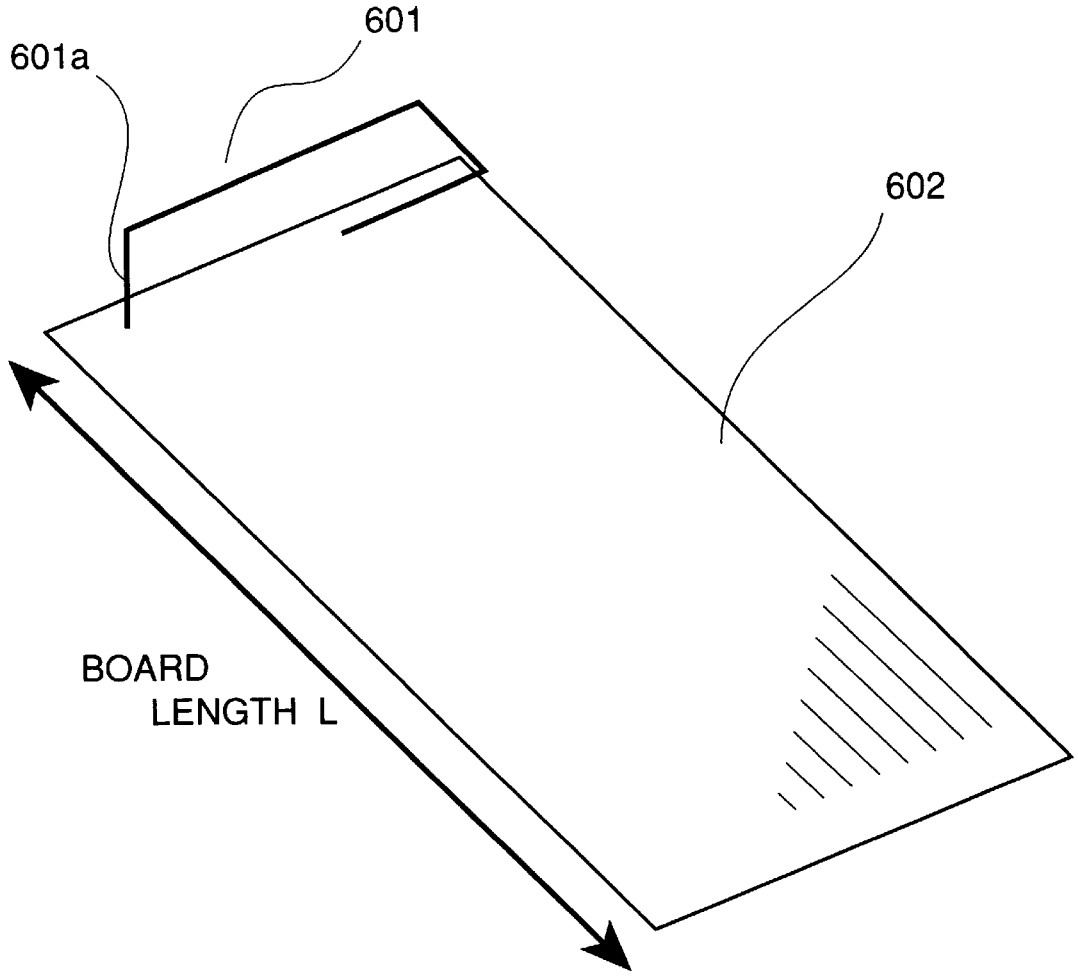
FIG. 6 is a perspective view of an antenna apparatus according to another embodiment of the present invention.

An antenna apparatus shown in FIG. 6 includes a power feed line 601 b. This antenna is called an inverted L antenna. The short-circuited line 601 a serves as a matching circuit in the inverted F antenna shown in FIG. 1. Since this matching circuit is not provided for the inverted L antenna shown in FIG. 6, matching between the antenna and the power-feed line deteriorates. Matching can be achieved in the inverted L antenna shown in FIG. 6 by providing a matching circuit (not shown) between the power-feed point of the antenna and the power-feed line.

Figure 7:
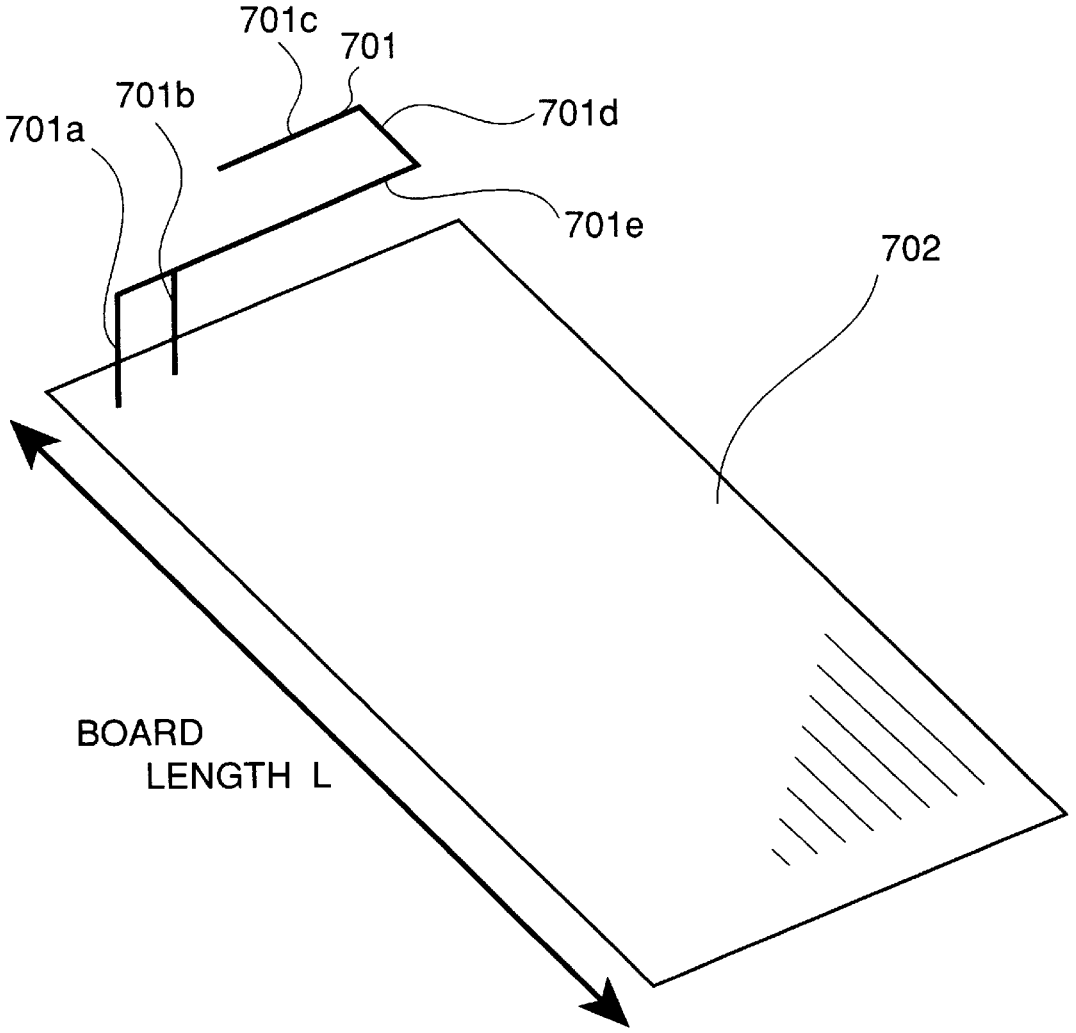
FIG. 7 is a perspective view of an antenna apparatus according to yet another embodiment of the present invention.
Figure 8:
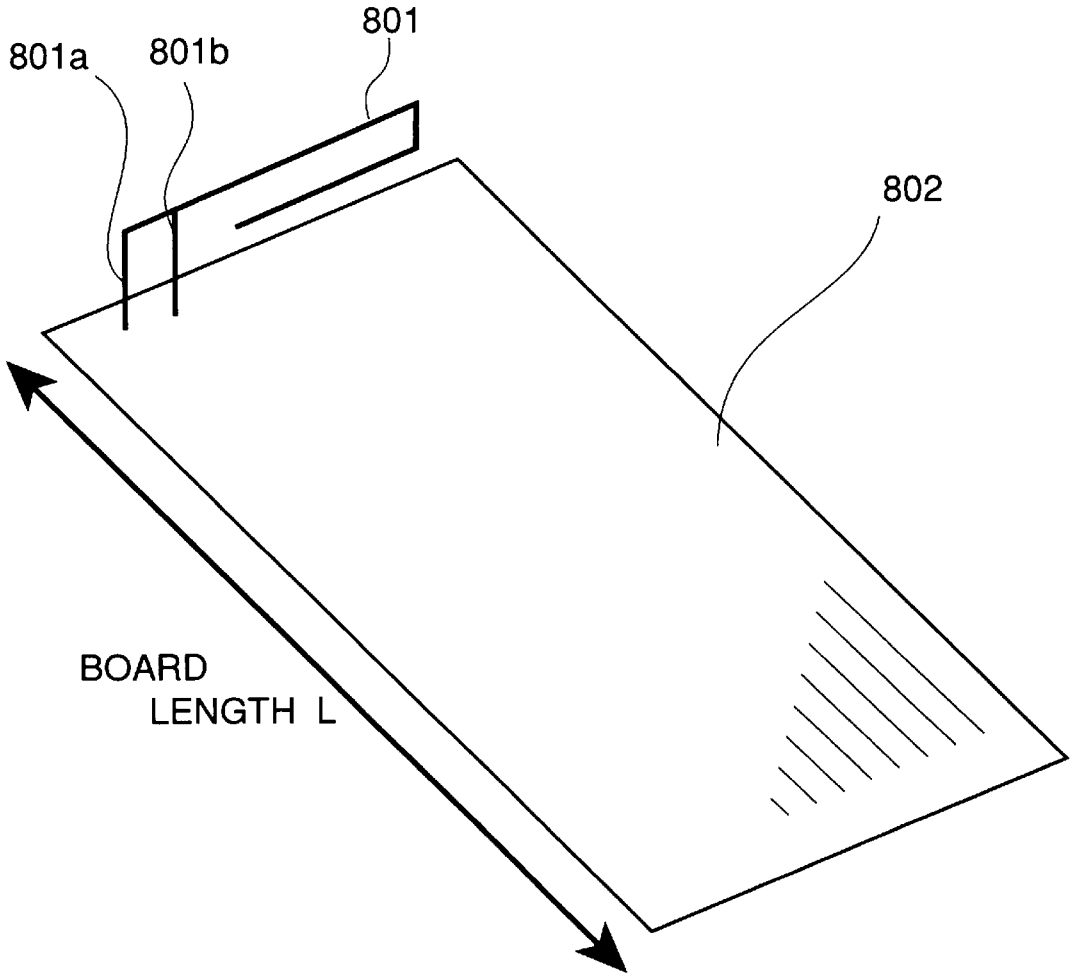
FIG. 8 is a perspective view of an antenna apparatus according to still another embodiment of the present invention.

FIGS. 7 and 8 show antenna apparatuses bent in different directions from that in the antenna 101 shown in FIG. 1. In the antenna apparatus 701 shown in FIG. 7, an antenna element is disposed in the direction away from a board 702. The antenna 701 includes a short-circuited line 701*a* and a power feed line 701*b*. In the antenna apparatus 801 shown in FIG. 8, an antenna element is disposed in a direction such that its tip is close to a board 802. The antenna 801 includes a short-circuited line 801*a* and a power feed line 801*b*. The elements are bent in a U shape with two right angles in these antennas. An operation of disposed sections is described below by referring to FIG. 7. Two sides 701*c* and 701*e* which are parallel in the U-shaped portion with two right angles are disposed such that they are always perpendicular to the longitudinal direction of the board 702. When this condition is satisfied, an antenna according to the present invention avoids current flow loss even if the antenna is disposed in any directions. In other words, under this condition, the currents flowing through antenna elements 701*c* and 701*e* do not cancel a current distributed on the board flowing in the longitudinal direction of the board. Therefore, the gain does not deteriorate due to the elements 701*c* and 701*e*, because a current flowing in the longitudinal direction of the board, which is the main radiation source, is not reduced. In the embodiment shown in FIG. 1, although the portion corresponding to an antenna element 701*d* slightly cancel a current on the board 102, its amount is much less than that in the conventional antenna apparatus. In the embodiments shown in FIGS. 7 and 8, the amount of canceled current on the board becomes smaller than in the embodiment shown in FIG. 1. When the portion 701*d* becomes long, however, a current on the board 702 is canceled thereby. Therefore, when the portion 701*d* is sufficiently short, for example, when it is equal to or shorter than one twentieth the wavelength, the effect caused by the portion 701*d* can be ignored.

Figure 9:
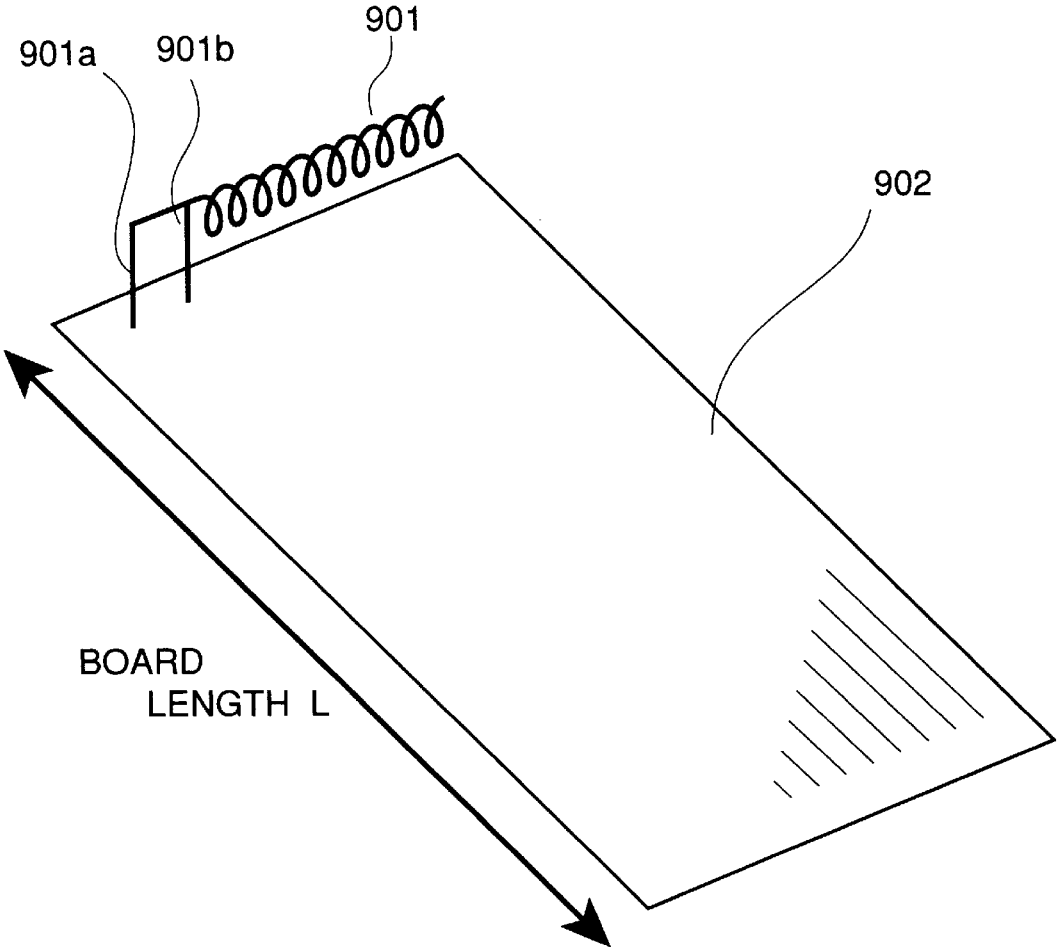
FIG. 9 is a perspective view of an antenna apparatus according to a further embodiment of the present invention.

FIG. 9 shows an inverted F antenna 901 in which an antenna element is made to have a coil shape so as to shorten its length. As compared with a folding method, this method reduces the operating frequency band of an antenna. However, radiation efficiency deteriorates little, since the amount of canceled current flowing in the longitudinal direction of the board decreases as compared with a folding method.

Figure 10:
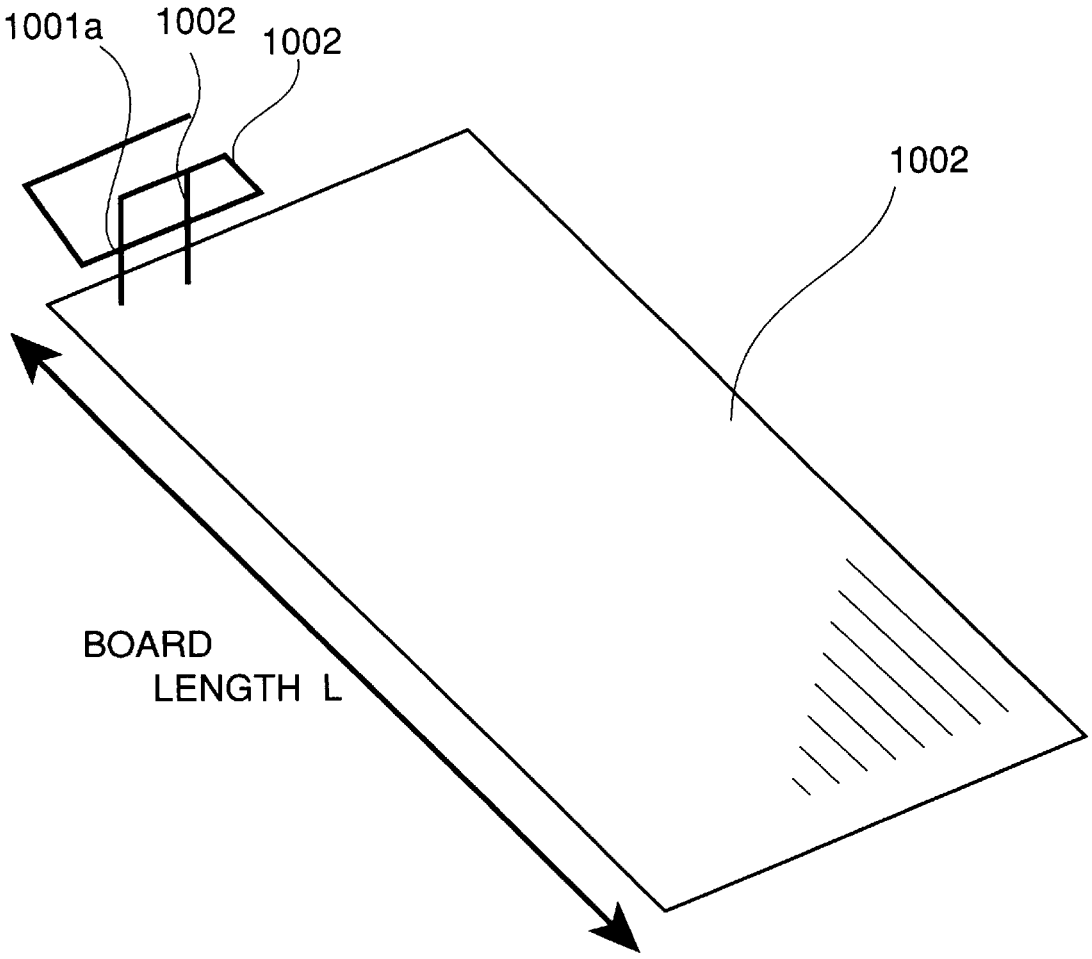
FIG. 10 is a perspective view of an antenna apparatus according to a yet further embodiment of the present invention.
Figure 11:
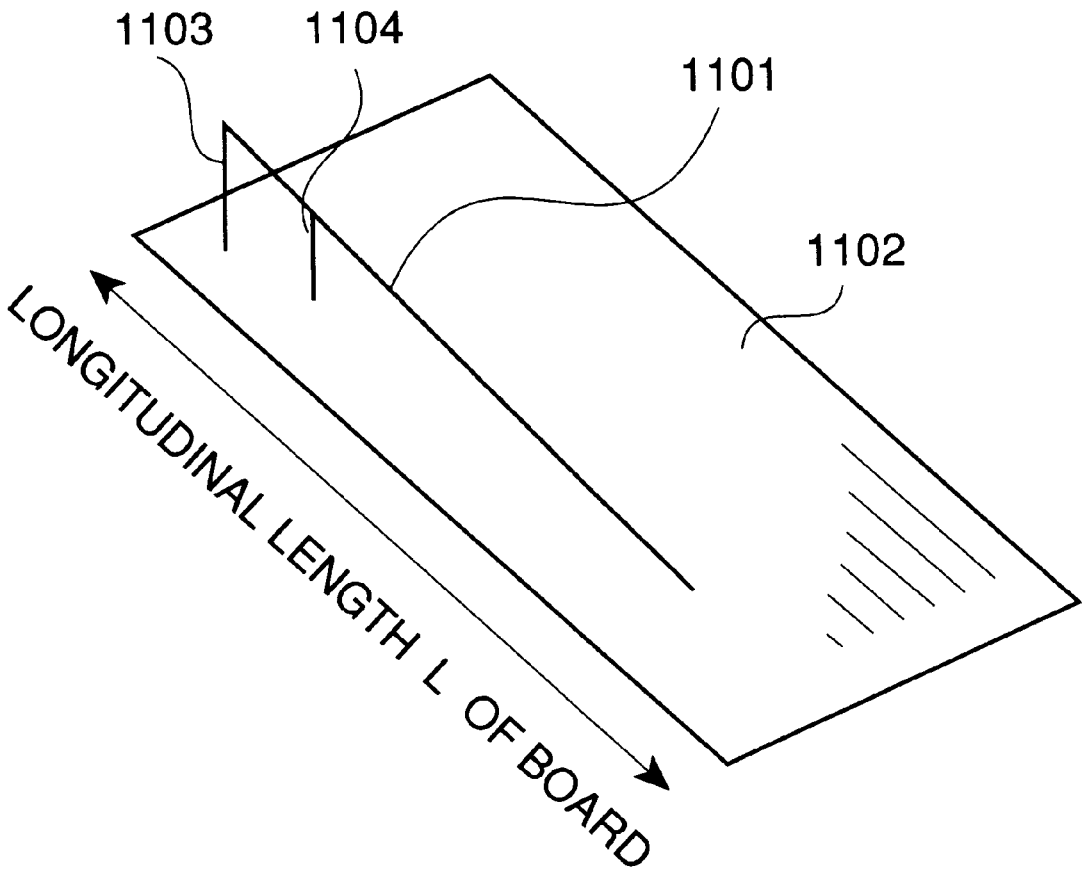
FIG.11 PRIOR ART
FIG. 11 is a perspective view of a conventional antenna apparatus.
Figure 12:
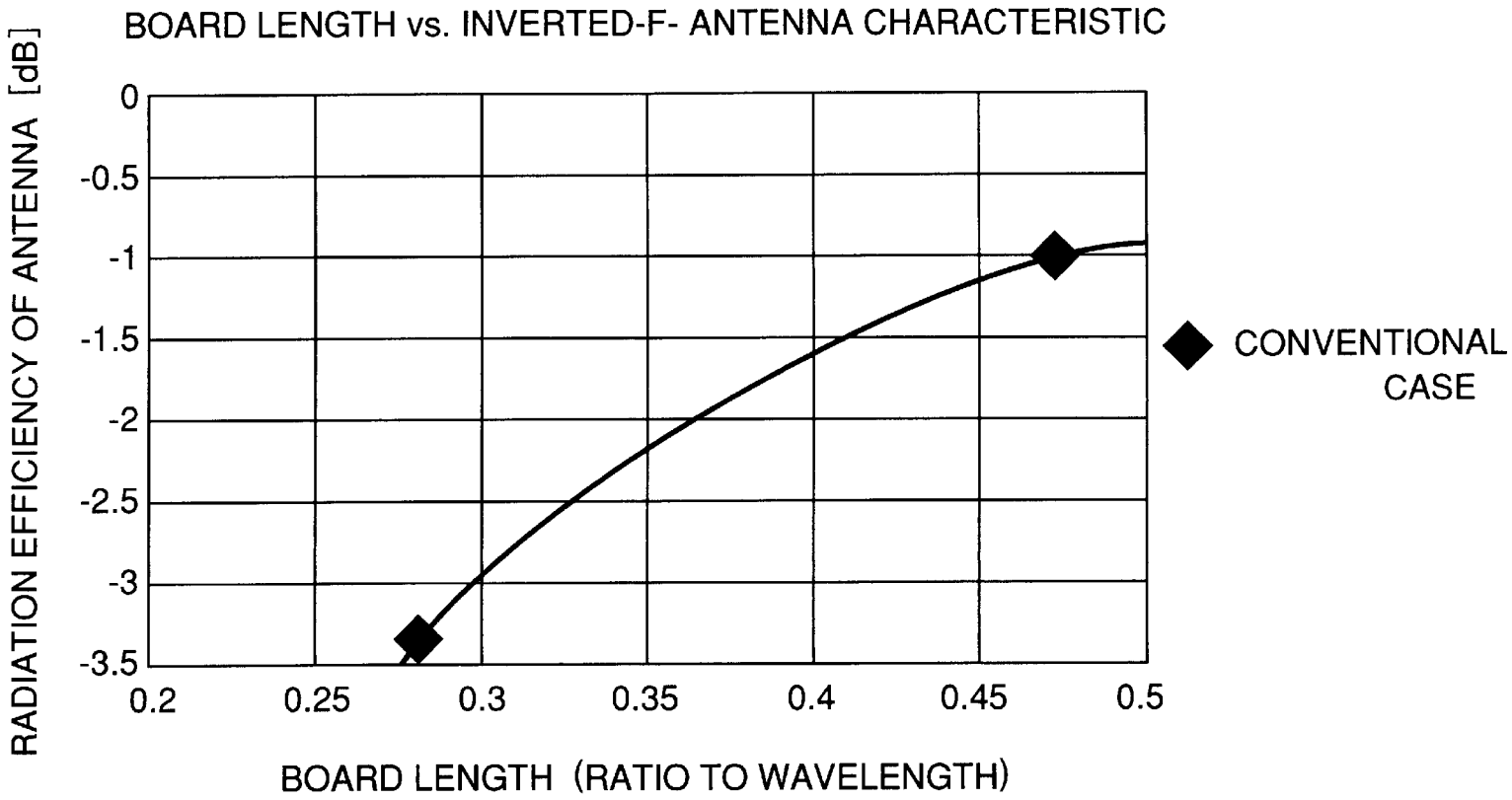
FIG.12 PRIOR ART
FIG. 12 is a graph showing a characteristic of the conventional antenna apparatus of FIG. 11.

FIG. 10 shows an antenna apparatus made by folding further the antenna element 101 shown in FIG. 1 to dispose the antenna near a corner of the board 102. With this structure, since a current G in FIG. 5, which cancels a current E, flows through a different position, radiation is generated from the current E. As a result, increased radiation is produced from the board 1002 and radiation efficiency increases.

As described above, in a conventional antenna apparatus employing a compact antenna such as a line-shaped inverted F antenna, its performance deteriorates as the conductor plate becomes small in size. The radiation efficiency of the antenna deteriorates especially when the board length in the longitudinal direction is one fourth the wavelength. As proposed by the present invention, however, when an inverted F antenna or an inverted L antenna is disposed perpendicularly to the longitudinal direction of the conductor plate, the above deterioration of the antenna efficiency is reduced.

What is claimed is:

1. An antenna apparatus comprising:

a rectangular-shaped conductor plate formed of electrically conductive material and having two sides in a longitudinal direction with a length of one fourth the wavelength corresponding to a certain operating frequency;

a short-circuited point disposed in the vicinity of one side of two sides substantially perpendicular to the two sides in the longitudinal direction of said rectangular-shaped conductor plate;

a first line-shaped element connected at one end to said rectangular-shaped conductor plate at said short-circuited point;

a power-feed point disposed in the vicinity of said one side of the two sides substantially perpendicular to the two sides in the longitudinal direction of said rectangular-shaped conductor plate;

a second line-shaped element connected at one end to said rectangular-shaped conductor plate at said power-feed point; and a third line-shaped element connected at one end to said first line-shaped element, connected to said second line-shaped element such that the length from said power-feed point to another end of the third line-shaped element is equal to one fourth the wavelength, and is disposed substantially perpendicularly to the two sides in the longitudinal direction of said rectangular-shaped conductor plate, wherein said power-feed point and said short-circuited point are disposed in the vicinity of a corner of said rectangular-shaped conductor plate, and wherein said third line-shaped element is disposed substantially at a right angle at a first disposed section near the other end and disposed substantially at a right angle at a second disposed section closer to the other end than the first disposed section.

2. An antenna apparatus according to claim 1, wherein the other-end of said third line-shaped element disposed at the second disposed section is substantially perpendicular to the two sides in the longitudinal direction of said rectangular-shaped conductor plate.

3. An antenna apparatus according to one of claim 1, wherein a portion from the first disposed section to the second disposed section of said third line-shaped element is substantially parallel to the two sides in the longitudinal direction of said rectangular-shaped conductor plate, wherein said portion corresponds to said second part of said third element.

4. An antenna apparatus according to claim 3, wherein the portion from the first disposed section to the second disposed section of said third line-shaped element is disposed toward said rectangular-shaped conductor plate.

5. An antenna apparatus according to claim 1, wherein said third line-shaped element is disposed substantially at a right angle at a first disposed section near the other end, disposed substantially at a right angle at a second disposed section closer to the other end than the first disposed section, and disposed substantially at a right angle at a third disposed section closer to the other end than the second disposed section.

6. An antenna apparatus comprising:

a rectangular-shaped conductor plate formed of electrically conductive material and having two sides in a longitudinal direction which have a length of one fourth the wavelength corresponding to a certain operating frequency;

a power-feed point disposed in the vicinity of one side of two sides of the rectangular-shaped conductor plate substantially perpendicular to the two sides in the longitudinal direction of said rectangular-shaped conductor plate;

a first line-shaped element connected at one end to said rectangular-shaped conductor plate at said power-feed point; and a second line-shaped element connected at one end to said first line-shaped element, having the length from said power-feed point to the other end equal to one fourth the wavelength, and disposed substantially perpendicularly to the two sides in the longitudinal direction of said rectangular-shaped conductor plate, wherein said power-feed point is disposed in the vicinity of a corner of said rectangular-shaped conductor plate, and wherein said second line-shaped element is disposed substantially at a right angle at a first disposed section near the other end and disposed substantially at a right angle at a second disposed section closer to the other end than the first disposed section.

7. An antenna apparatus according to claim 6, wherein the other-end of said second line-shaped element disposed at the second disposed section is substantially perpendicular to the two sides in the longitudinal direction of said rectangular-shaped conductor plate.

8. An antenna apparatus according to one of claim 6, wherein a portion from the first disposed section to the second disposed section of said second line-shaped element is substantially parallel to the two sides in the longitudinal direction of said rectangular-shaped conductor plate wherein said portion corresponds to said second part of said third element.

9. An antenna apparatus according to claim 8, wherein the portion from the first disposed section to the second disposed section of said second line-shaped element is disposed toward said rectangular-shaped conductor plate.

10. An antenna apparatus according to claim 6, wherein said second line-shaped element is disposed substantially at a right angle at a first disposed section near the other end, disposed substantially at a right angle at a second disposed section closer to the other end than the first disposed section, and disposed substantially at a right angle at a third disposed section closer to the other end than the second disposed section.

* * * * *